United States Patent [19]

Augspurger et al.

[11] Patent Number: 4,817,939

[45] Date of Patent: Apr. 4, 1989

[54] CYCLE TRAINING DEVICE

[76] Inventors: Quent Augspurger; Charles H. Bartlett, both of 2519 E. Thomas Rd. #A, Phoenix, Ariz. 85016

[21] Appl. No.: 138,152

[22] Filed: Dec. 28, 1987

[51] Int. Cl.[4] ..... A63B 69/00

[52] U.S. Cl. ..... 272/73; 272/129

[58] Field of Search ..... 272/73, 129, DIG. 5, 272/DIG. 6; 310/36, 76; 211/17, 20–24

[56] References Cited

U.S. PATENT DOCUMENTS

| | | | |
|---|---|---|---|
| 2,623,302 | 12/1952 | Shields | 272/73 |
| 3,705,721 | 12/1972 | Lulay | 272/73 |
| 3,903,613 | 9/1975 | Bisberg | 272/73 |
| 3,975,652 | 8/1976 | Hammond | 310/76 |
| 4,082,265 | 4/1978 | Berkes | 272/73 |
| 4,415,152 | 11/1983 | Smith | 272/73 |
| 4,585,977 | 4/1986 | Arbisi et al. | 310/36 |
| 4,595,194 | 6/1986 | Previtali | 272/73 |
| 4,613,129 | 9/1986 | Schroeder et al. | 272/129 |
| 4,709,917 | 12/1987 | Yang | 272/73 |

*Primary Examiner*—V. Millin
*Assistant Examiner*—S. R. Crow
*Attorney, Agent, or Firm*—Gregory J. Nelson

[57] ABSTRACT

An exercise device having a stand adapted to support a bicycle. The stand has a wheel support which permits side-to-side pivotal motion of the support and bicycle. A roller engages the rear wheel of the bicycle and is in driving relationship through a clutch with an AC induction motor connected to a power indicating device.

9 Claims, 3 Drawing Sheets

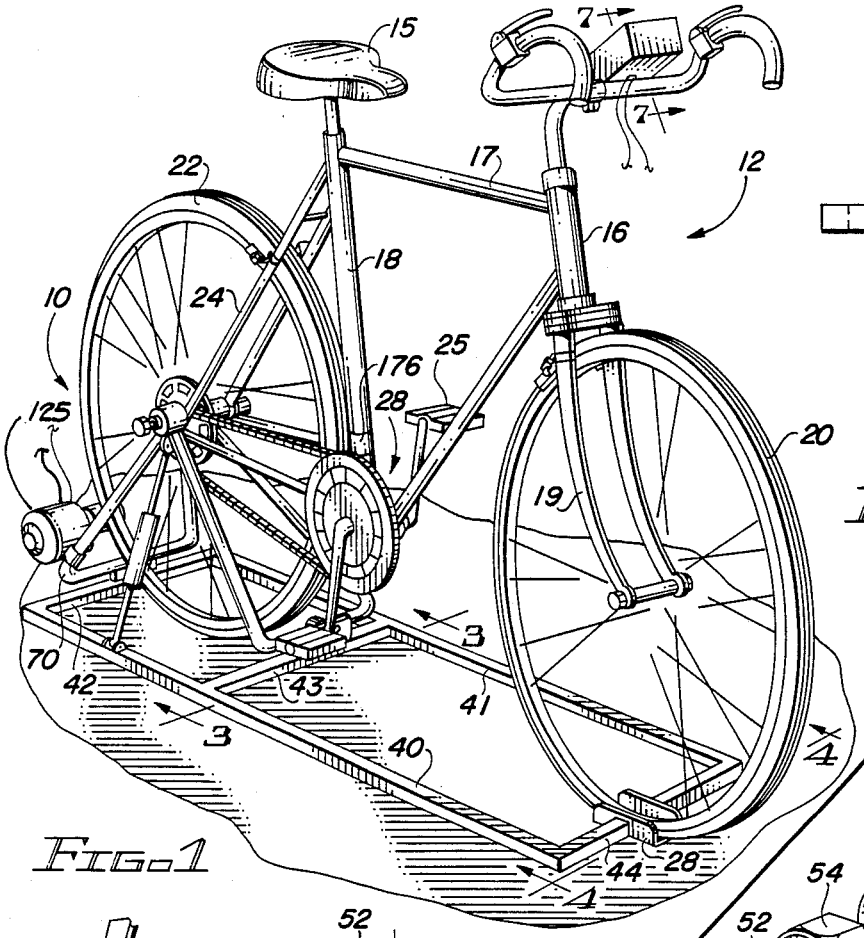
FIG. 1
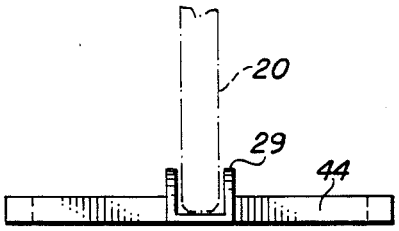
FIG. 4
FIG. 5
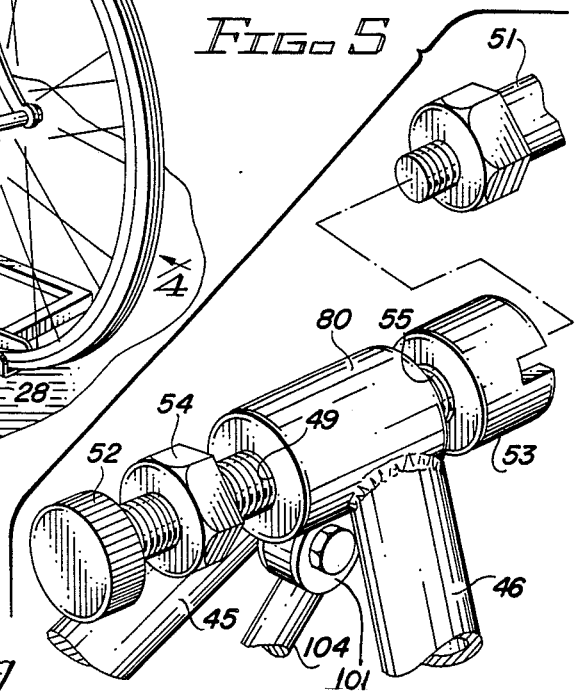
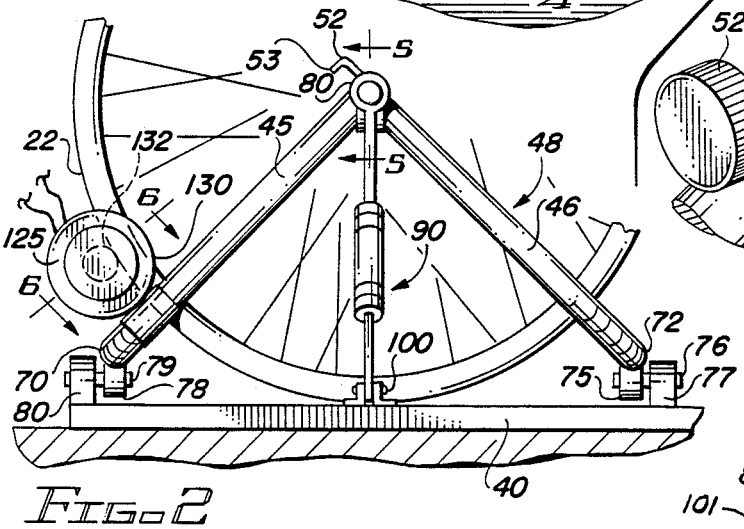
FIG. 2
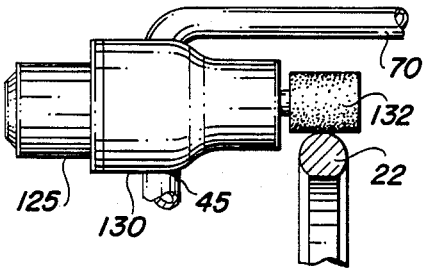
FIG. 6
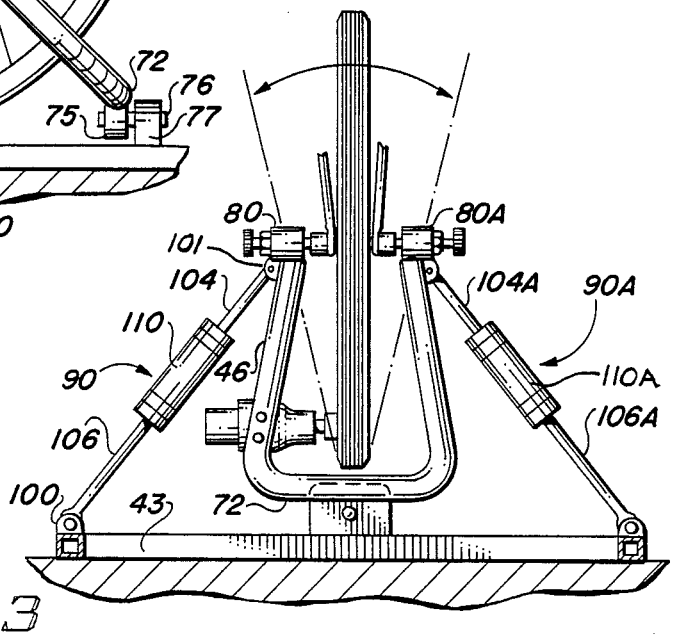
FIG. 3

CYCLE TRAINING DEVICE

The present invention relates to a physical training device and more particularly relates to a stationary exercising device adapted to support a conventional bicycle so that the bicycle may be operated as a stationary exercise machine.

It is well documented in the literature that bicycling is one of the most beneficial forms of exercise in that it is aerobic causing the individual to sustain an elevated pulse beat without the detrimental impact which is attendant to other forms of exercise such as running or jogging. Bicycling is also popular since it is an activity which can be performed by individuals of all ages. However, there are situations when time constraints, weather or other conditions do not permit the rider to engage in bicycling out-of-doors on a road or street. In this situation, many riders have training stands which support the bicycle in a stationary position which allow the bicyclist to achieve the benefits of exercise while indoors. Generally these stands support the bicycle in a stationary position with the rear wheel engaging some type of resistance device to enhance the exercise effect. For example, it is common that the rear wheel engage and drive a roller which, in turn, drives a fan or impeller which provides increased resistance as peddle speed increases.

When an individual is engaged in exercise on a stationary bicycle, it is highly desirable that the bicycle rider have some indication of the amount of energy expended as an indication of the level of exercise. There are various devices in the prior art which are adapted for use with a stationary bicycle apparatus and which provide the rider some indication of the exercise benefit achieved so that the rider may measure the exercise and may also use the stationary bike as a physical training device.

For example, U.S. Pat. No. 3,210,634 shows a bicycle-operated generator in which a belt extends around the rear armature of a rotary generator. The generator is connected to a battery and the operator may determine when insufficient current is being generated from an ammeter and accordingly increase the pumping and exercise effort.

U.S. Pat. No. 3,240,947 discloses an emergency power system which is manually operated and which includes an improved converter and inverter for rectification of alternating current during conversion of AC power to DC power and which functions during inversion to minimize the generation of high amplitude peak voltages which are normally encountered in such circuits.

U.S. Pat. No. 3,984,666 shows an exercising device having an alternator/rectifier driven by a bicycle wheel. The energy input to the alternator is derived from the exerciser. The output power of the alternator/rectifier is absorbed by a loading resistor. As the individual exercises, the physical work output is converted to electrical power by the alternator/rectifier to be dissipated by the load resistor.

U.S. Pat. No. 4,613,129 shows an attachment which converts a stationary exercise bicycle into an electronic exercise machine. Varying loads are provided by an alternator which can be accurately controlled as to the resistance offered to the peddling effort of the bicyclist. The alternator is hinged to a floor plate and can be raised about a hinged connection to an operating position in which the bicycle wheel is contacted by a drive wheel for driving the alternator. The load encountered by the rider can be varied as desired by changing the electromagnetic field of the alternator. The alternator output signal provides an indication of speed and amount of energy expended.

U.S. Pat. No. 3,705,721 discloses an exercise device having a regulated electrical generator or alternator driven by an exercise bicycle. The magnitude of load for the generator may be selected by the user through a load circuit.

U.S. Pat. No. 4,595,194 shows a portable and collapsible bicycle training stand or apparatus.

As demonstrated above, there are a number of stationary exercise devices in the prior art which provide variable resistance to the rider and which provide the rider with an indication of speed and amount of energy expended. By and large, these are expensive devices as they are either DC devices or AC devices which require some type of rectification. The other approach found in the prior art is simple mechanical resistance such as ergometer devices which generally utilize a flywheel and some type of friction device. These devices are often bulky and friction resistance devices are subject to mechanical wear and tear. The present device overcomes the disadvantages of many of the prior art mechanical and electrical exercise devices in that the present invention is an AC device which eliminates the requirement for rectification of AC current and which device is effective and is basically self-limiting or controlling as it is an overdrive-type device. The device of the present invention is simple and allows the individual to utilize the individual's own bicycle unlike many ergometer-type exercise bicycles.

Briefly, in accordance with the present invention, the device of the invention has a frame or stand adapted to support a conventional bicycle such as a 10 or 15 speed bicycle. The device has a wheel support which includes opposed strut or shock absorbers which attach at one end to the rear wheel axle of the bicycle and which are pivotally secured at their opposite ends to the frame to permit limited angular tilting or freedom of motion of the bicycle. A roller engages the rear wheel of the bicycle and is driven by the rear wheel and is in driving engagement with the shaft of an AC induction motor through a clutch arrangement. The clutch permits the motor to be driven by the bicycle wheel in only one rotational direction which corresponds to the normal rotational direction of the motor. A watt meter or other power indicating device is connected in the motor circuit. When the rider pedals the bicycle, the roller is driven and when the synchronous speed of the motor is reached, the motor is overdriven and becomes an asynchronous generator which will generate power into the electrical circuit which is reflected on the watt meter. Typically this would occur when the rider reaches a speed which drives the roller at 1800–3600 r.p.m. The watt meter may be calibrated to provide the user a reading of calories expended or some other indication of energy output. The device may also include a cadence counter. The motor circuit may also include an appropriate switch to maintain the motor in an "off" condition until the rider brings the bicycle to synchronous speed.

The above and other objects and advantages of the present invention will become more apparent from the following description, claims and drawings in which:

FIG. 1 is a perspective view of the bicycle training apparatus of the present invention with a bicycle positioned upon the apparatus;

FIG. 2 is a side view of the rear portion of the frame of the training apparatus with a bicycle wheel positioned thereon;

FIG. 3 is a sectional view taken along lines 3—3 of FIG. 1;

FIG. 4 is a sectional view taken along lines 4—4 of FIG. 1;

FIG. 5 is a sectional view taken along lines 5—5 of FIG. 2 showing the upper end of the rear wheel support;

FIG. 6 is a sectional view taken along lines 6—6 of FIG. 2 showing the motor and drive roller;

Figure 7:
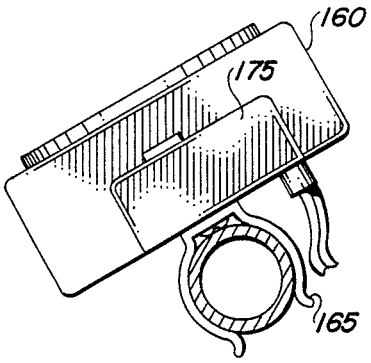
FIG. 7 is a sectional view taken along lines 7—7 of FIG. 1 showing the power indicating device.

Turning now to the drawings, the exercise and training device of the present invention is generally designated by the numeral 10 which supports a bicycle 12 having a frame including a seat 15, tube 16, cross-bar 17 and down tube 18. A fork 19 extends from the front part of the frame which supports a front wheel assembly 20. The rear wheel assembly 22 is rotatively connected to the rear frame member 24 and is driven by a pedal assembly 25 through a drive chain and chain wheel and sprocket assembly 28 as is well known in the art. The description of the bicycle is general and as the bicycle forms no part of the present invention and is set forth only to facilitate an understanding of the present invention which may be used in connection with any conventional style of bicycle.

The training device 10 has a base including a pair of longitudinally extending spaced-apart frame members 40 and 41 which preferably extend a distance at least corresponding to the approximate diameter of the rear wheel and, as shown, may extend a distance corresponding generally to the length of the bicycle. Transverse members 42, 43 and 44 extend between frame members 40 and 41 at rear, intermediate and front locations. The terms "front" and "rear" are used to designate locations in accordance with the orientation of bicycle 12 with the front of the frame, for example, corresponding to the front of the bicycle.

The rear bicycle wheel is supported in a pivotally mounted support 48. The support 48 includes a pair of braces 45 and 46 diverging outwardly at either side of the wheel 22 from clamping hub 80 and extending around the wheel converging at the opposed clamping hub 80A as best seen in FIGS. 2 and 3. As best seen in FIG. 5, hubs 80 and 80A each receives a clamp screw 55 which has a clamp cone 53 engageable at the opposite ends of the rear axle 51. The clamp screw is axially adjustable at outer knob 52 and when adjusted may be locked at lock nut 54. The front wheel 20 is supported in channel 29 at cross frame member 44, as seen in FIG. 4.

Braces 45 and 46 are each generally U-shaped extending around the periphery of the rear bicycle wheel at bight sections 70 and 72, respectively, and are connected to the right side of the bicycle at hub 80 and to the left side of the bicycle at hub 80A. Bight section 72 of brace 46 is pivotally mounted to cross frame member 43 at bearing 75 which is rotatable on shaft 76 supported by block 77 at a location corresponding to the centerline of the bicycle. Similarly bight section 70 of brace 45 is pivotally mounted to rear cross member 42 at bearing 78 on shaft 79 which is supported by block 80 at a location corresponding to the centerline of the bicycle. It will be apparent that the support 48 is transversely pivotal about a longitudinal axis extending at a location generally corresponding to the lowermost point on the rear tire 22. This allows the rider limited side movement closely approximating the "lean" that occurs when cornering a bicycle, particularly at higher speeds.

The pivotal movement of support 48 is resisted by opposed strut assemblies 90 and 90A. As best seen in FIGS. 2 and 3, strut assembly 90 is pivotally connected at its upper end to hub 80 at clevis 101 and pivotally connected at its lower end to longitudinal frame member 40 at clevis 100. Strut 90 forms an approximate angle of 45° with respect to horizontal. Strut assembly 90 includes oppositely extending rods 104 and 106 which have their inner ends slidable within cylinder 110 which houses a resistance member such as a compression spring. The inner ends of rods 104 and 106 oppositely engage the compression spring. Alternatively, cylinder 110 may be a single acting hydraulic or compressed gas cylinder so that strut assembly 90 will retract and extend to provide predetermined resistance to the limited range of angular side-to-side motion of the bicycle induced by the user.

A similar strut assembly 90A is provided at the right side of the bicycle wheel as viewed in FIG. 3. Assembly 90A includes a cylinder 110A having oppositely extending rods 104A and 106A which pivotally connect to hub 80A and frame member 43, respectively, to provide a predetermined resistance to tilting to the left of the rider. At a predetermined maximum angle of tilt, the strut assemblies will extend and retract to the maximum limiting further tilt. Typically the strut assemblies will limit maximum tilt to about 15° in either direction from vertical as seen in FIG. 3.

It will thus be seen that when the conventional bicycle is placed on the base with the opposite ends of the rear axle 51 engaged and locked in clamping hubs 80 and 80A, the bicycle will be stabilized in a position with the rear wheel slightly elevated so the bicycle may be peddled in stationary fashion with the rear wheel engaging a roller, as will be explained. Further, the support assembly allows some angular side-to-side movement of the bicycle particularly at higher speeds which movement tends to closely simulate the actual motion encountered when riding a bicycle, particularly when cornering.

Figure 8:
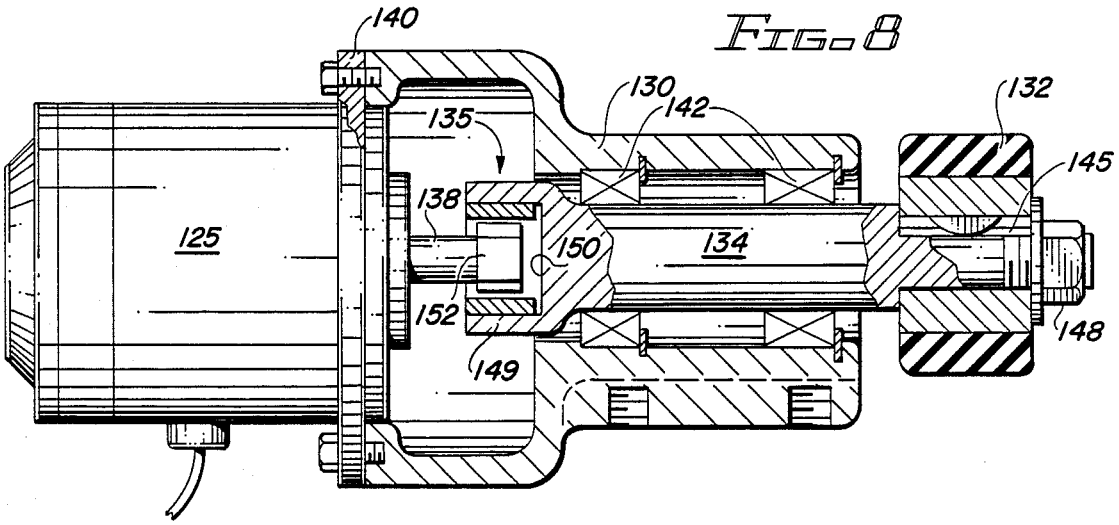
FIG. 8 is a view, partly in section, of the clutch and motor.
Figure 9:
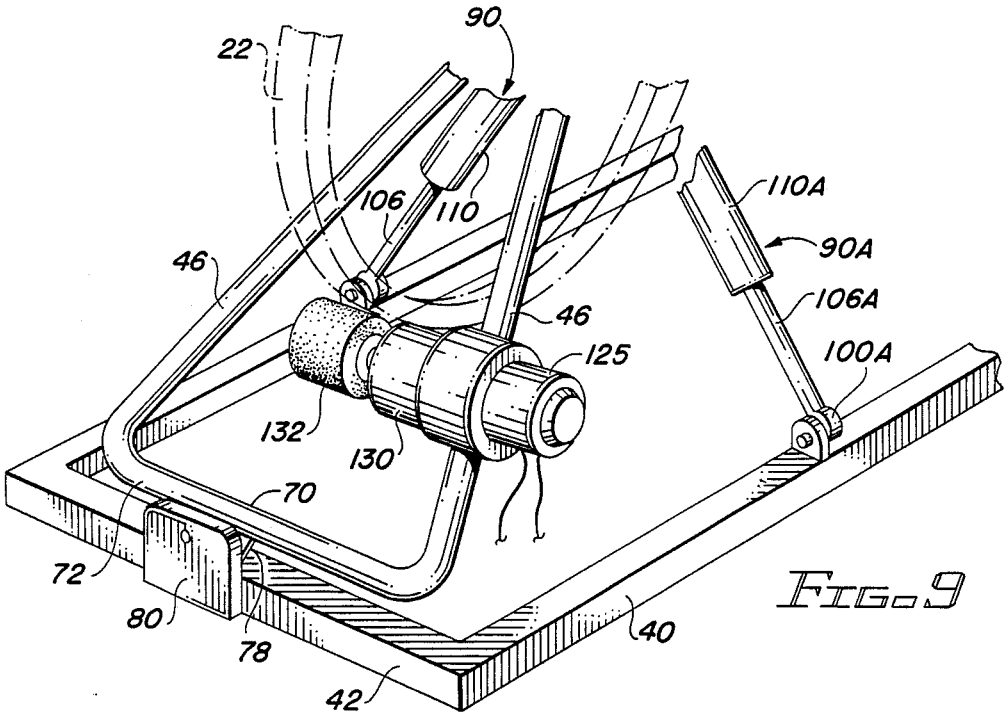
FIG. 9 is a perspective view of a rear portion of the frame and drive.

In order to provide the user with an indication of the energy expended, the device of the present invention is provided with an electrical resistance device. The electrical resistance device includes an AC induction motor 125 which is mounted on support 48 adjacent the rear wheel 22 of the bicycle. AC induction motor may be typically a ⅛ horse power such as the type manufactured by Emerson and designated as Model 2097. As best seen in FIGS. 6 and 8, motor 125 is affixed to clutch housing member 130. Roller 132 is supported on the end of shaft 134 for rotation with the shaft which is mounted in bearings 142 in the clutch housing Roller 132 engages the rear wheel of the bicycle when the bicycle is in place on the training device and the outer surface of roller 132 is rubber or other material having suitable frictional characteristics. Clutch assembly 135 operates to permit motor 125 to be driven only in one direction of operation by roller 132, as will be explained in greater detail hereafter.

Motor 125 is an AC induction motor and has an output shaft 138 which extends axially within housing 130 with the motor being secured at plate 140 to the housing 130 by bolts or similar fasteners. Transfer shaft 134 is axially mounted within housing 130 in bearings 142. The outer end of transfer shaft 134 defines an axially extending keyway 145 so that roller 132 may be affixed by a key to the shaft allowing the transfer shaft 134 and roller 132 to rotate as a unit. The outer end of shaft 134 is threaded to receive a nut or other fastener 148 to secure roller 132 in position on the end of the shaft.

The inner end of transfer shaft 134 is configured having an enlarged bell section 149 which defines a circular recess, the periphery of which closely corresponds to the outer roller clutch member 150. The outer end of motor shaft 138 is provided with a cylindrical sleeve 152 which engages the rollers of a conventional roller clutch member 150. The operation of the clutch 135 has an overrun mode and a lock mode. The operational mode is controlled by the direction of rotation of shaft 134. Thus, if through rotation of the roller 132 shaft 134 is rotated in a direction opposite the normal running rotational direction of the motor 125, the clutch is free to run and the motor shaft 138 may freely rotate within the clutch and the shaft 134 may rotate about the motor shaft. In the opposite direction of rotation of shaft 134 which would be normally induced by the user peddling the bicycle in a forward direction, the clutch 135 will engage causing a direct drive relationship to exist from the rotor to the motor.

Various roller clutch assemblies of this type are well known in the prior art and, for example, a Torrington Type RC roller clutch may be used for this purpose. It has been found that the RC-121610 roller clutch may be incorporated in the clutch housing to provide overrun in one direction of rotation and the locking mode in the opposite direction of operation. With the clutch described, in the overrun position, the relative rotation between the housing, clutch and shaft causes a series of circumferential rollers to move away from a locked position against special configured locking ramps in the clutch. The housing and clutch are thus free to overrun in one direction where the shaft is free to turn in the other direction. Accordingly, when the user pedals the bicycle in a normal forward direction driving the wheel clockwise as viewed in FIG. 1, roller 132 will be driven in a counter-clockwise direction causing torque to be transmitted between members 149 and 150 driving the motor shaft in the same direction of rotation as the roller.

If the rotation of the bicycle wheel 22 is driven in the reverse direction by the individual, the roller and connecting shaft 134 will turn freely being disengaged at clutch 135 from motor shaft 138. Further the motor cannot drive the wheel in the reverse direction due to the disengagement of the motor and roller at the clutch.

Figure 10:
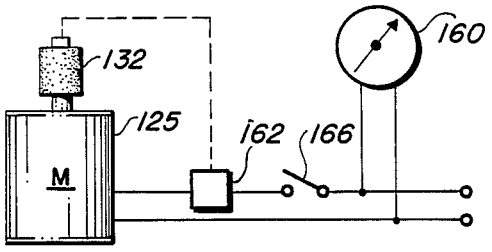
FIG. 10 is an electrical schematic of the motor circuit.

Motor 125 is an induction motor of the AC synchronous type. The clutch permits the motor only to be driven in one direction which direction corresponds to the normal forward peddling direction of the bicycle. When the rider peddles the bicycle, roller 132 is driven and when the synchronous speed of the motor is reached, the motor is overdriven and the motor becomes an asynchronous generator and begins to generate power into the circuit which is reflected on the watt meter 160. FIG. 10 shows the typical circuit arrangement with the motor connected to a conventional source of AC power. A watt meter 160 or other power measuring device is connected in the circuit and provides a measure of the amount of power generated by the user once synchronous speed is reached. The watt meter or power meter may be calibrated to provide the user a reading of calories expended or some other similar indication of work or energy output and as shown in FIG. 7, the meter 160 is detachably mounted in the handle bars of the bicycle by a clip 165 engageable about the horizontal portion of the handle bars in a position easily viewable by the user.

As shown in FIG. 10, a centrifugal switch 162 may be provided in the electrical circuit so that the motor is not energized until the user reaches a predetermined speed which speed approximately corresponds to the synchronous speed of the motor. Once this speed is reached, the circuit is completed and at the synchronous speed the motor is overdriven becoming a generator with the amount of power generated into the circuit reflected on the meter as an indication of energy expended by the user.

In order for the user to have an indication of energy expended at speeds below the speed at which the motor becomes a synchronous generator, a cadence sensor 176 may be attached to the post 18 of the bicycle to register peddle rotation. Typical cadence counters are available and as for example may be of the type sold under the trademark "Cateye" Model 40-4500, as manufactured by Cateye. The output from the cadence counter can then be read directly by the user on an indicator 175 mounted at meter 160 and may be converted to give an approximate value of energy based on certain measured or assumed values. For example, in order to rotate the bicycle wheel at a certain speed it can be empirically determined that a certain amount of energy is expended. The indicator 175, either a digital or analog read-out, can be calibrated to provide a reading or indication of energy expenditure at various peddle speeds up to the speed at which motor 125 is energized and begins to operate as a synchronous generator at which time the power meter 160 will provide the user with an accurate indication of energy expenditure based on voltage and current generation.

Figure 11:
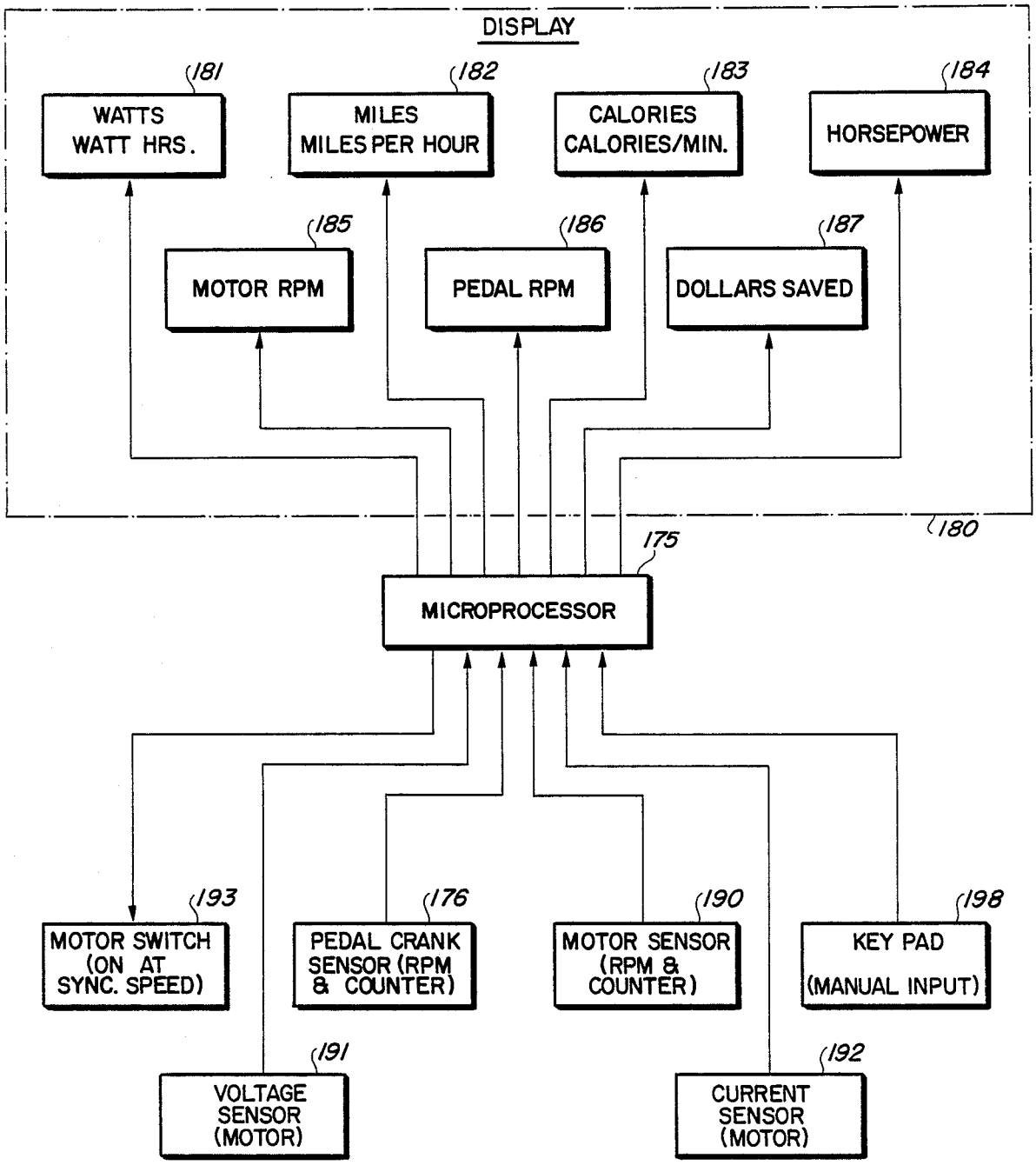
FIG. 11 is a schematic of a microprocessor based monitoring and display system that may be incorporated as part of the device of the present invention.

The present invention also lends itself to the addition of more sophisticated monitoring systems. FIG. 11 shows such a system. Here the indicator 180 viewable by the user will indicate or display watts at 181, miles per hour at 182, calories expended at 183, horsepower at 184, motor rpm at 185 and pedal rpm at 186. Display 187 indicates energy savings realized by the generation of power into the electrical grid system.

Pedal crank sensor 176 inputs to microprocessor 180. Similarly, sensors 190, 191 and 192 monitor motor rpm's, motor voltage and motor current and the output from these sensors are provided as inputs to microprocessor 175. Switch 193 serves to activate the motor only at a predetermined speed as for example the synchronous speed of the motor. Manual input to change displays or to program the unit is by means of key pad 198.

A typical display and the required inputs are as follows:

| Display Capabilities | |
|---|---|
| Stop Watch | |
| Output Desired: | |
| Instantaneous | Digits |
| 1. Watts | 0.00 |
| *2. Speed MPH | 00.0 |
| *3. Calories/Min. | 000 |
| *4. Motor RPM | 0000 |
| 5. Horsepower | 0.0 |
| *6. Pedal RPM | 000.0 |
| Accumulating Resetable | |
| 1. Watt - HR | 000.0 |
| *2. Distance - Miles | 000.0 |
| *3. Calories | 0000 |
| 4. Money Saved | $0.00 |
| Totalizing Non-Reset | |
| *1. Distance/Miles | 00000 |
| 2. Payback | Paidback 0 Times |
| Inputs Required: | |
| Fixed Assumption | |
| 1. Watts vs. Calories | Conversion |
| 2. Bicycle Efficiency | |
| 3. Generator Efficiency | |
| Fixed Elect or Mech. | |
| *1. Motor Speed RPM & Accumulating Counter | |
| 2. Voltage | |
| 3. Amperage | |
| Operator Input | |
| 1. Elect. Cost Avg. cents per KWH | |
| A. Last Mo. Bill Amt. | |
| B. Last Mo. Bill KWH | |

(*Motor not Required On)

From the foregoing it will be obvious to those skilled in the art that various changes, alterations and modifications may be made to the physical training device of the present invention. To the extent, such changes, alterations and modifications do not depart from the spirit and scope of the appended claims, they are intended to be encompassed therein.

We claim:

1. A stationary exercise apparatus for use with a conventional bicycle having a frame-mounted wheel on an axle driven through a rider-operated pedal mechanism, said apparatus comprising:

(a) a base member for supporting said bicycle;

(b) power generating means including:

(i) an AC induction motor having a shaft, said motor connectable in a power circuit and being an asynchronous generator upon reaching a predetermined speed;

(ii) motion sensing means engageable with said bicycle wheel and adapted to be driven thereby; and (iii) uni-directional clutch means operatively interposed between said motor shaft and said motion sensing means whereby said motor shaft is driven only in one rotational direction by operation of said bicycle through the full range of operational speeds;

(c) indicator means connected to said motor providing an indication of the power generated by said motor upon said motor reaching synchronous speed;

(d) a support member pivotally mounted on said frame, said support member extending at opposite sides of the bicycle wheel and having hubs detachably securable at opposite ends of the said axle supporting the wheel, said support member being mounted to provide limited pivotal movement of the wheel and bicycle about a longitudinal axis extending adjacent the lower-most point on the wheel; and (e) switch means in said power circuit operative to energize said motor only when a predetermined pedal speed is achieved by the rider which speed approximately corresponds to the synchronous speed of the motor, such that when the pedal speed falls below the synchronization speed, the motor disconnects from the power circuit but the one-way clutch remains engaged as long as the pedals are operated.

2. The apparatus of claim 1 wherein said clutch is a roller type clutch.

3. The apparatus of claim 1 wherein said indicator means includes sensors monitoring motor function and pedal speed, microprocessor means for receiving the output of said sensors, and display means for indicating predetermined display modes representative of the activity level of the user.

4. The apparatus of claim 1 wherein said switch means is operatively controlled by said microprocessor.

5. The apparatus of claim 1 wherein said display means include speed, and energy dissipation, power absorbed and generated by the motor.

6. The apparatus of claim 1 further including an energy indicating device providing the rider an indication of work expended at speeds below the said predetermined speed at which the motor becomes an asynchronous generator.

7. A stationary exercise apparatus for use with a conventional bicycle having a frame-mounted wheel on an axle driven through a rider-operated pedal mechanism, said apparatus comprising:

(a) a base member for supporting said bicycle;

(b) power generating means including:

(i) an AC induction motor having a shaft, said motor connectable in a power circuit and being an asynchronous generator upon reaching a predetermined speed;

(ii) motion sensing means engageable with said bicycle wheel and adapted to be driven thereby; and (iii) uni-directional clutch means operatively interposed between said motor shaft and said motion sensing means whereby said motor shaft is driven only in one rotational direction by operation of said bicycle through the full range of operational speeds;

(c) indicator means connected to said motor providing an indication of the power generated by said motor upon said motor reaching synchronous speed;

(d) a support member pivotally mounted on said frame, said support member extending at opposite sides of the bicycle wheel and having hubs detachably securable at opposite ends of the said axle supporting the wheel, said frame being mounted to provide limited pivotal movement of the wheel and bicycle about a longitudinal axis extending adjacent the lower-most point on the wheel; and (e) strut members extending between said hubs and said base member at opposite sides of said wheel, said strut members including extendable and retractable actuator means to limit the side-to-side pivotal movement of the bicycle.

8. The apparatus of claim 7 wherein said actuator is a fluid actuator.

9. The apparatus of claim 7 wherein said actuator is a mechanical actuator incorporating spring means.

* * * * *